US005707948A

United States Patent [19]

Evers et al.

[11] Patent Number: 5,707,948

[45] Date of Patent: Jan. 13, 1998

[54] STABLE AND CLEAR CONCENTRATED CLEANING COMPOSITIONS COMPRISING AT LEAST ONE SHORT CHAIN SURFACTANT

[75] Inventors: Marc Francois Theophile Evers, Strombeek-Bever; Vincent Reniers, Tienen; Peter Rosalia Joannes Geboes, Aartselaar; Massimo Morini, Jette; Louise Gail Scott, Sterrebeek, all of Belgium; Daniel Wayne Michael, Mainville; Nicola John Policicchio, Mason, both of Ohio

[73] Assignee: The Procter & Gamble Company, Cincinnati, Ohio

[21] Appl. No.: 522,354

[22] PCT Filed: Mar. 14, 1994

[86] PCT No.: PCT/US94/02748

§ 371 Date: Feb. 2, 1996

§ 102(e) Date: Feb. 2, 1996

[87] PCT Pub. No.: WO94/21768

PCT Pub. Date: Sep. 29, 1994

[30] Foreign Application Priority Data

| | | | |
|---|---|---|---|
| Mar. 19, 1993 | [EP] | European Pat. Off. | 93870050 |
| Jul. 7, 1993 | [EP] | European Pat. Off. | 93870126 |
| Nov. 16, 1993 | [EP] | European Pat. Off. | 93870215 |

[51] Int. Cl.[6] ..... C11D 3/10; C11D 1/83; C11D 1/831

[52] U.S. Cl. ..... 510/217; 510/365; 510/422; 510/424; 510/427; 510/430; 510/432; 510/435; 510/437; 510/495; 510/497; 510/505; 510/509

[58] Field of Search ..... 510/421, 422, 510/424, 426, 427, 429, 430, 432, 437, 505, 495, 497, 498, 365, 217, 435, 509

[56] References Cited

U.S. PATENT DOCUMENTS

| | | | |
|---|---|---|---|
| 3,983,078 | 9/1976 | Collins | 510/453 |
| 4,235,758 | 11/1980 | Dawson et al. | 510/429 |
| 4,272,395 | 6/1981 | Wright | 510/384 |
| 4,671,895 | 6/1987 | Erilli et al. | 510/340 |
| 5,057,246 | 10/1991 | Bertho et al. | 510/423 |
| 5,318,728 | 6/1994 | Surutzidis et al. | 510/323 |

*Primary Examiner*—Ardith Hertzog
*Attorney, Agent, or Firm*—Robert B. Aylor

[57] ABSTRACT

Stable and clear concentrated cleaning compositions comprising at least one short chain surfactant, optionally in combination with long chain nonionic surfactant and potassium carbonate. The short chain surfactants allow for the formulation of stable compositions without the need for additional stabilizers and are especially effective in cleaning greasy soil; the potassium carbonate provides reduced filming and streaking, especially when an anionic sulfonate short chain surfactant is present.

3 Claims, No Drawings

STABLE AND CLEAR CONCENTRATED CLEANING COMPOSITIONS COMPRISING AT LEAST ONE SHORT CHAIN SURFACTANT

TECHNICAL FIELD

The present invention relates to concentrated cleaning compositions. Although the present invention relates primarily to cleaning compositions for hard surfaces, it may also be of interest for other cleaning compositions including dishwashing and laundry detergent compositions.

BACKGROUND OF THE INVENTION

Concentrated cleaning compositions are well known in the art. Concentrated compositions are mainly characterized by the fact that they comprise a higher concentration of active ingredients compared to a conventional cleaning composition, and a problem which is typically encountered when formulating concentrated cleaning compositions is therefore the physical stability of such compositions. Indeed, because such compositions comprise a high amount of active ingredients in a limited amount of water, stability problems appear which lead, if not solved, to compositions which separate into several phases. This phenomenon affects the performance of the composition and is visually noticeable, thereby rendering such formulations unfit for commercialization.

Various solutions have been proposed to solve this problem which typically involve the use of specific stabilizing ingredients, or hydrotropes. Such ingredients have the sole function of stabilizing the composition. They thus increase the cost of formulating such compositions without providing any cleaning performance benefits, and they furthermore require to free up parts in the formulation which could otherwise be used to formulate more actives.

For instance, EP 316 726 discloses concentrated compositions in the form of microemulsions which comprise water, perfume, a surfactant and a so-called co-surfactant. The co-surfactant is said to reduce the interfacial tension at interfaces between dispersed and continuous phases of an emulsion of said surfactant, thereby creating a stable microemulsion. The so-called co-surfactants in the '726 publication are listed as specific glycol ethers, which are traditionally regarded as solvents in this field, or specific carboxylic acids. The co-surfactants in the '726 publication do not appear to participate to the overall cleaning performance of the product.

It is therefore an object of the present invention to formulate a stable concentrated cleaning composition without using ingredients which are provided for the sole purpose of providing stability to the compositions herein, but which also participate significantly to the cleaning performance of said compositions.

It has now been found that this object can be met by formulating a concentrated aqueous compositions comprising at least one short chain surfactant, i.e. with a hydrophobic group consisting of a $C_6$–$C_{10}$ alkyl chain, said compositions not being in the form of microemulsions. Said short chain surfactants provide stability to the compositions herein and, in the same time, significantly boost the overall cleaning performance, especially grease cleaning, both in neat and dilute usage.

SUMMARY OF THE INVENTION

The compositions herein are stable clear concentrated cleaning compositions comprising from 10% to 90% by weight of the total composition of water and at least one short chain surfactant comprising a $C_6$–$C_{10}$ alkyl chain as its hydrophobic portion. The compositions herein are preferably not in the form of microemulsions.

DETAILED DESCRIPTION OF THE INVENTION

The compositions of the present invention are concentrated aqueous compositions. By concentrated, it is meant herein that the compositions comprise from 10% to 90% by weight of the total composition of water, preferably from 15% to 75%, most preferably from 30% to 70%.

The compositions according to the present invention are clear and stable. By clear and stable, it is meant herein that the compositions of the present invention are macroscopically substantially transparent, in the absence of any opacifier, and that said compositions do not macroscopically separate into separate phases during at least 1 month, at temperatures ranging from 4° C. to 50° C., upon standing.

The compositions according to the present invention further comprise at least one short chain surfactant, or mixtures thereof. All surfactants have in common that they comprise a hydrophobic portion and a hydrophilic portion. By short chain surfactant, it is meant herein surfactants which comprise a $C_6$–$C_{10}$ alkyl chain as their hydrophobic portion. Such short chain surfactants are accordingly those conventionally used in this field, but with a shorter alkyl chain, and can be of any type. Accordingly, suitable short chain surfactants for use herein include $C_6$–$C_{10}$ alkyl sulfates ($C_6$–$C_{10}SO_4$), alkyl ether sulfates ($C_6$–$C_{10}(OCH_2CH_2)_eSO_4$), alkyl sulfonates ($C_6$–$C_{10}SO_3$), alkyl succinates ($C_6$–$C_{10}OOCCH_2CH_2COOZ$), alkyl carboxylates ($C_6$–$C_{10}COOM$), alkyl ether carboxylates ($C_6$–$C_{10}(OCH_2CH_2)_eCOOM$), alkyl sarcosinates ($C_6$–$C_{10}CON(CH_3)R$), alkyl sulfo succinates ($C_6$–$C_{10}OOCCH(SO_3M)CH_2COOZ$), amine oxides ($C_6$–$C_{10}RR'NO$), glucose amides ($C_6$–$C_{10}CONR''X$), alkyl pyrrolidones ($C_6$–$C_{10}(C_4H_6ON)$), alkylpolysaccharides ($C_6$–$C_{10}OG_g$), alkyl alkoxylates ($C_6$–$C_{10}(OCH_2CH_2)_e(OCH_2CH_2CH_2)_pOH$) and betaines ($C_6$–$C_{10}N^+(CH_3)_2CH_2COO$—). In the formulae in brackets, e and p are independently from 0 to 20 and e+p>0, Z is M or R, M is H or any counterion such as those known in the art, including Na, K, Li, $NH_4$, amine, X is a polyhydroxyhydrocarbyl having a linear hydrocarbyl chain with at least 3 hydroxyls directly connected to the chain, or an alkoxylated derivative thereof, R, R and R''' are $C_1$–$C_5$ alkyl groups, possibly functionalized with hydroxyl groups, R and R' are preferably $C_1$–$C_3$, most preferably methyl, R'' is preferably 2-hydroxyethyl or 2 hydroxypropyl, G is a saccharide, preferably glucose, and g is of from 1.5 to 8. All these surfactants are well known in the art. A more complete disclosure of conventional glucose amides can be found for instance in WO 92-06154 and a more complete disclosure of conventional alkyl polysaccharides can be found for instance in U.S. Pat. No. 4,536,319. The compositions according to the present invention may comprise any of the above surfactants alone, or any combination thereof, depending on the end use envisioned.

Preferred short chain nonionic surfactants for use herein are alkyl alkoxylates according to the formula $C_6$–$C_{10}(OCH_2CH_2)_e(OCH_2CH_2CH_2)_pOH$, where e and p representing respectively the degree of ethoxylation and propoxylation, are independently of from 0 to 20, and that e+p>0. Most preferred short chain nonionic surfactants for use herein are those where e and p are such that e+p is from 3 to 10, particularly those where p is 0 and e is from 3 to 8.

Also, most preferred short chain nonionic surfactants for use herein are those where said short chain is a hydrocarbon chain comprising from 7 to 10 carbon atoms. Said preferred short chain nonionic surfactants for use herein can be manufactured by the processes well known to the man skilled in the art, such as condensation of the corresponding alcohol and alkylene oxide, but such short chain surfactants are more conveniently commercially available for instance from Sidobre under the trade name Mergital@$C_4$ ($C_8EO4$), from Kolb under the trade names Imbentin@ AG/810/050 and AG/810/080 (respectively $C_8$-10EO5 and $C_8$-10EO8).

Preferred short chain anionic surfactants for use herein are $C_6$–$C_{10}$ alkyl sulfates ($C_6$–$C_{10}SO_4$) and alkyl sulfonates ($C_6$–$C_{10}SO_3$). Most preferred are the $C_6$–$C_8$ alkyl sulfates and sulfonates. The alkyl sulfonates can provide products with less filming/streaking, as demonstrated hereinafter, as compared to other anionics such as alkyl sulfates. Such short chain anionic surfactants can be made by well known sulphation or sulphonation processes followed by neutralization, but said anionic short chain surfactants are more conveniently commercially available, for instance from Rhone Poulenc under the trade name Rhodapon@ OLS, or from Witco under the trade name Witconate@.

The compositions according to the present invention may comprise from 0.1% to 50% by weight of the total composition, preferably from 1% to 40%, most preferably from 1.5% to 30% of said short chain surfactants. It has been found that said short chain surfactants allowed the formulation of concentrated compositions without the need for any stabilizing systems, or certain formulation type such as microemulsions. Said short chain surfactants are also particularly effective in cleaning, especially grease cleaning.

The compositions according to the present invention may comprise short chain surfactants only, or combinations of short chain surfactants with conventional longer chain surfactants. Accordingly, suitable long chain surfactants for use herein include those listed herein above in the description of short chain surfactants, but with a longer alkyl chain, of from $C_{11}$–$C_{24}$. Preferred long chain surfactants for use herein are long chain alkyl sulfonates, e.g. paraffin sulfonates and alkyl ethoxylates, and mixtures thereof.

If combinations of short chain and long chains are used, it is preferred to observe certain ratios: if short chain anionic surfactants are used, it is preferred to observe a minimum weight ratio of short chain anionic surfactant to longer chain surfactant of 1:10. If short chain nonionic surfactants are used, it is preferred to observe a minimum weight ratio of short chain nonionic to longer chain surfactant of 1:5.

Depending on the end use envisioned, the compositions herein may further comprise a variety of other optional ingredients including builders, alkanolamines, pH adjusting agents, perfumes, dyes, bleaches, enzymes and the like. When an alkalinity source is present, it is desirable that the potassium cation be used, E.g., when potassium carbonate is used at a level of from about 1% to about 4% instead of sodium carbonate, as demonstrated hereinafter, there is less filming/streaking. As used herein, potassium carbonate comprises potassium bicarbonate. The potassium carbonate is preferably present at a level of about 1% to about 4% by weight of the total composition.

In some instances, it may be appropriate to include a suds suppressing system in the compositions herein. Said suds suppressing system can advantageously be a mixture of 2-alkyl alkanols as described for instance in DE 40 21 265, or mixtures thereof, with a $C_8$ to $C_{22}$ fatty acid, or mixtures thereof. Such a system is particularly advantageous as both ingredients appear to act in synergy. Thus even a very low amount of said system is enough to control suds efficiently. Accordingly, said system is present in amounts of from 0.1% to 5% by weight of the total composition, preferably 0.5% to 3%.

The compositions herein do not require the presence of a stabilizing compound. By stabilizing compound, it is meant herein a compound whose sole function is to enhance the physical stability of the composition. Such compounds are typically xylene or toluene sulphonate salts, and glycol ethers, including ethylene glycol monobutyl ether, diethylene glycol monobutyl ether, dipropylene glycol monobutyl ether, dipropylene glycol methyl ether, propylene glycol methyl ether, tripropylene glycol methyl ether, propylene glycol monobutyl ether and other various solvents such as ethanol and butanol. Accordingly, the compositions of the present invention are preferably substantially free of such stabilizing compounds.

The present invention further encompasses a method of cleaning a hard surface which comprises the steps of diluting a composition according to the preceding claims in water, then applying it to said hard surface. Depending on the exact formulation, the compositions herein may be used both neat and diluted from 10 to 500 times.

Particularly preferred compositions contain: (1) from 5% to 30% of short chain surfactant, preferably a mixture of (a) short chain nonionic surfactant having the formula $C_{6-10}(EO)_c(PO)_pOH$ wherein EO is an ethoxy moiety, PO is a propoxy moiety with each c and p being from 0–20, preferably from 3 to 10, more preferably c being from 3 to 8 and p being 0 and (b) $C_{6-10}$ alkyl sulfonate, (2) optional, but preferred, long chain nonionic surfactant, preferably nonionic $C_{12-16}(EO)_n$, preferably a mixture of nonionic surfactants in which one has an n of from about 2 to about 10 and the other has an n of from about 20 to about 60; (3) optional hydrophobic cleaning solvent, preferably $C_{2-6}(EO)_x(PO)_yOH$ wherein x and y are each from 0 to about 2, and more preferably $C_4(EO)_2OH$; (4) optional, but preferred, fatty acid suds suppressant at a level of from 0.1% to 1%, preferably from 0.2% to 0.8%; (5) optional, but preferred, $C_{12-18}$ fatty alcohol, more preferably branched chain fatty alcohols such as 2-butyl octanol and/or 2-hexyl decanol; and (6) optional, but preferred, alkalinity source, more preferably potassium carbonate. The balance of each composition is preferably an aqueous solvent system.

The present invention will be further illustrated by the following examples.

EXAMPLES

The following compositions are made by mixing the listed ingredients in the listed proportions.

| | I | II | III | IV |
|---|---|---|---|---|
| $C_{13}/_{15}$ alkyl ethoxylate $EO_3$ | 3 | — | 3 | — |
| $C_{12}/_{15}$ alkyl ethoxylate $EO_{30}$ | 5 | 5 | — | — |
| $C_8$ alkyl sulfate | — | 10 | 10 | — |
| $C_8$ alkyl sulfonate | — | — | — | 20 |
| $C_8$ alkyl ethoxylate $EO_6$ | — | 9 | — | — |
| $C_9/_{10}$ alkyl ethoxylate $EO_5$ | — | — | — | 20 |
| Citric acid | 3 | 3 | 1 | — |
| Monoethanolamine | 3 | 3 | 1 | 1 |
| Triethanolamine | — | — | 3 | — |
| Water & minors | | up to 100% | | |

All compositions were evaluated for their physical stability at 4° C., at room temperature (20° C.), and at 50° C.

Composition I, which is not within the invention, was a gel at 4° C., and an emulsion at room temperature and at 50° C. All other compositions, within the invention, were clear transparent liquids in the same conditions.

Other compositions were made by mixing the listed ingredients in the listed proportions.

| | V | VI | VII | VIII |
|---|---|---|---|---|
| C13/15 alkyl ethoxylate EO3 | 4 | 3 | 5 | 1 |
| C13/15 alkyl ethoxylate EO7 | — | 3 | — | 5 |
| C7–9 alkyl sulfate | 7.5 | — | — | — |
| C8 alkyl sulfate | — | 8 | — | 10 |
| C8 alkyl sulfonate | — | — | 10 | — |
| C7–9 alkyl ethoxylate EO6 | — | — | 10 | 5 |
| C8–10 alkyl ethoxylate EO5 | 10 | 9 | — | 9 |
| C13/15 alkyl ethoxylate EO30 | 6 | 4 | 3 | 5 |
| Na Paraffin Sulfonate | — | 5 | — | — |
| Citric acid | 3 | — | — | 3 |
| Sodium carbonate | — | 3 | — | — |
| 2-hexyl decanol | 1 | 0.6 | 1 | — |
| Palm Kernel Fatty Acid | 0.4 | 0.4 | 1 | — |
| Water & minors | | up to 100% | | |

The invention is illustrated by the following examples. All values in table are weight percentages.

| Example No.: Ingredient | 1 Wt % | 2 Wt % | 3 Wt % |
|---|---|---|---|
| Sodium Octyl Sulfate | 7.0 | — | — |
| Sodium Octyl Sulfonate | — | 7.0 | 7.0 |
| Alfonic R 810-65 ($C_{8-10}$ $EO_6$ average) | 10.0 | 10.0 | 10.0 |
| Neodol R 23-3 ($C_{12-13}$ $EO_3$) | 4.0 | 4.0 | 4.0 |
| Lutensol R AO-30 ($C_{13-15}$ $EO_{30}$) | 6.0 | 6.0 | 6.0 |
| Sodium Carbonate | — | 2.0 | — |
| Potassium Carbonate | 2.0 | — | 2.0 |
| Palm Kernel Fatty Acid | 0.4 | 0.4 | 0.4 |
| 2-Butyl Octanol | 0.4 | 0.4 | 0.4 |
| Hydrophobic Perfume* | 1.5 | 1.5 | 1.5 |
| Deionized Water and Minors | q.s. | q.s. | q.s. |
| pH | 10.8 | 10.8 | 10.8 |

Alfonic is a trade name used by Vista Chemical.
Neodol is a trade name used by Shell Chemical Co.
Lutensol is a trade name used by BASF Corp.
*Hydrophobic perfume consists of terpenes, terpene alcohols, and other perfume materials which are typically insoluble in water.

The invention is also illustrated by the following Examples. All values in table are weight percentages.

| Example No.: Ingredient | 4 Wt % | 5 Wt % |
|---|---|---|
| Sodium Octyl Sulfonate | 7.0 | 7.0 |
| Alfonic R 810-65 ($C_{8-10}$ $EO_6$ average) | 10.0 | 10.0 |
| Neodol R 23-3 ($C_{12-13}$ $EO_3$) | 4.0 | 4.0 |
| Lutensol R AO-30 ($C_{13-15}$ $EO_{30}$) | 6.0 | 6.0 |
| Diethylene Glycol Monobutyl Ether | 3.0 | — |
| Potassium Carbonate | 2.0 | 2.0 |
| Palm Kernel Fatty Acid | 0.4 | 0.6 |
| 2-Butyl Octanol | 0.4 | — |
| Hydrophobic Perfume* | 1.5 | 1.5 |

-continued

| Example No.: Ingredient | 4 Wt % | 5 Wt % |
|---|---|---|
| Deionized Water and Minors | q.s. | q.s. |
| pH | 10.5 | 10.5 |

Alfonic is a trade name used by Vista Chemical.
Neodol is a trade name used by Shell Chemical Co.
Lutensol is a trade name used by BASF Corp.
*Hydrophobic perfume consists of terpenes, terpene alcohols, and other perfume materials which are typically insoluble in water.

Filming/Streaking data were obtained on the above Examples.

Filming/Streaking Test Method—Dilute (No Wax Floors)

Materials

1. Spontex cellulose sponges (cut to 2"×4"×1")
2. No wax floor tiles (12"×12")
3. Test products—these are diluted with heated tap water that has been adjusted to a hardness of 7 grains and maintained at 110° F. Dilution is 1 part test product:128 parts water.

Procedure:

1. Clean the floor tiles with tap water using a sponge. Then rinse with distilled water and dry with paper towels. Apply a small amount of isopropyl alcohol to each tile and dry thoroughly.
2. Clean sponges of all factory preservatives and rinse well. Use the same sponge for the entire test, rinsing well between change of products. Soak the sponge in the product being tested.
3. Transfer 15 mls of the diluted test product into an inverted sponge carrier.
4. Squeeze out excess product from the sponge and dip the sponge evenly on the flat surface of the carrier, gently squeezing down to soak up the product into the sponge. Tare the sponge on a 2-place balance, product side up.
5. One tile is used per replicate. The sponge is wiped lighty over the tile surface by drawing an "M" pattern which covers the entire tile as much as possible. Then another "M" is drawn sideways. Place the sponge on the tared balance and record the amount of product applied to the tile.
6. Three replicates are used for each product tested.
7. Tiles are air dried in air with 52% relative humidity at room temperature (about 24° C.) for approximately one hour.
8. Three expert graders grade the panels on the following scale system:

0=no filming/streaking

6=very poor filming/streaking

Grades are averages for each product.

Filming/Streaking Data

| Formula No. | Filming/Streaking Mean Grade |
|---|---|
| 3 | 1.4 |
| 2 | 1.8 |
| 1 | 2.1 |

The LSD for this test was 0.2 at the 95% Confidence Interval, therefore the Filming/Streaking mean values achieved for each formula are statistically distinct from one another. The superior Filming/Streaking result was achieved through a combination of both the octyl sulfonate (3 vs 1) and the potassium carbonate (3 vs 2).

What is claimed is:

1. A stable and clear concentrated cleaning composition comprising by weight:

(1) from 5% to 30% of short chain surfactant comprising a mixture of (a) nonionic surfactant having the formula $C_{6-10}(EO)_cOH$ in which c is from 3 to 8 and (b) $C_{6-10}$ alkyl sulfonate;

(2) long chain surfactant comprising a mixture of (a) nonionic surfactant having the formula $C_{12-16}(EO)_nH$ in which n is from about 2 to about 10 and (b) nonionic surfactant having the formula $C_{12-16}(EO)_nH$ in which n is from about 20 to about 60;

(3) optionally, hydrophobic cleaning solvent having the formula $C_{2-6}(EO)_x(PO)_yOH$ in which x and y are each from 0 to about 2;

(4) from 0.5% to 3% suds suppressant comprising a mixture of $C_{8-22}$ fatty acid and 2-alkyl alkanol;

(5) from about 1% to about 4% potassium carbonate;

(6) from about 30% to about 70% water; and wherein in the above formulae, EO represents an ethoxy moiety and PO represents a propoxy moiety.

2. The composition of claim 1 which is substantially free of stabilizing compounds.

3. The process of cleaning a hard surface comprising diluting the composition of claim 1 with water and applying it to said hard surface.

* * * * *